US008596091B2

(12) United States Patent
Aymes

(10) Patent No.: US 8,596,091 B2
(45) Date of Patent: Dec. 3, 2013

(54) JEWELLERY ASSEMBLY MADE UP OF AT LEAST THREE INTERCONNECTED PARTS

(75) Inventor: Frédéric Aymes, Neuilly sur Eure (FR)

(73) Assignee: Aymes, Neuilly sur Eure (FR)

( * ) Notice: Subject to any disclaimer, the term of this patent is extended or adjusted under 35 U.S.C. 154(b) by 148 days.

(21) Appl. No.: 13/055,772

(22) PCT Filed: Jul. 24, 2009

(86) PCT No.: PCT/EP2009/059593

§ 371 (c)(1),
(2), (4) Date: Mar. 21, 2011

(87) PCT Pub. No.: WO2010/010182

PCT Pub. Date: Jan. 28, 2010

(65) Prior Publication Data

US 2011/0203316 A1 Aug. 25, 2011

(30) Foreign Application Priority Data

Jul. 25, 2008 (FR) ..... 08 55103

(51) Int. Cl.
*A44C 25/00* (2006.01)

(52) U.S. Cl.
USPC ..... 63/41

(58) Field of Classification Search
None
See application file for complete search history.

(56) References Cited

U.S. PATENT DOCUMENTS

| | | | | |
|---|---|---|---|---|
| 3,613,393 | A | 10/1971 | Lamoureux | |
| 5,927,104 | A | 7/1999 | Green | |
| 7,735,336 | B2 * | 6/2010 | Williams | 63/3 |

FOREIGN PATENT DOCUMENTS

| | | |
|---|---|---|
| CN | 201 192 130 | 2/2009 |
| DE | 299 18 218 | 1/2000 |
| DE | 203 05 328 | 7/2003 |
| GB | 2 022 988 | 12/1979 |

OTHER PUBLICATIONS

Preliminary Examination Report, mailed Mar. 16, 2011, for PCT/EP2009/059593; cited reference already mentioned in previous invention disclosure statement.

International Search Report for PCT/EP2009/059593, mailed Dec. 28, 2009.

Foreign-language Written Opinion of the International Searching Authority for PCT/EP2009/059593, mailed Dec. 28, 2009.

* cited by examiner

*Primary Examiner* — Jack W. Lavinder

(74) *Attorney, Agent, or Firm* — Nixon & Vanderhye, PC

(57) ABSTRACT

The present invention relates to a jewelry assembly made up of at least three parts, especially a ring and a pair of earrings, which can be connected together to create, for example, a single stable geometrical shape using separate connection means. For this purpose, a jewelry assembly (1) according to the invention is of the type that comprises at least three parts forming a matching set, in which a ring (10) has a body (14) with a through hole (11) and two earrings (20, 30) both have ornamental portions (21), means of attachment (23) to the earlobes and cylindrical intermediate portions (22) between said attachment means (23) and said ornamental portions (22) to allow insertion into the hole (11) in said ring (10), said assembly being characterized in that it comprises a joining means comprising at least one annulus for connecting the earrings (20, 30) to said ring (10).

14 Claims, 6 Drawing Sheets

JEWELLERY ASSEMBLY MADE UP OF AT LEAST THREE INTERCONNECTED PARTS

Figure 1:
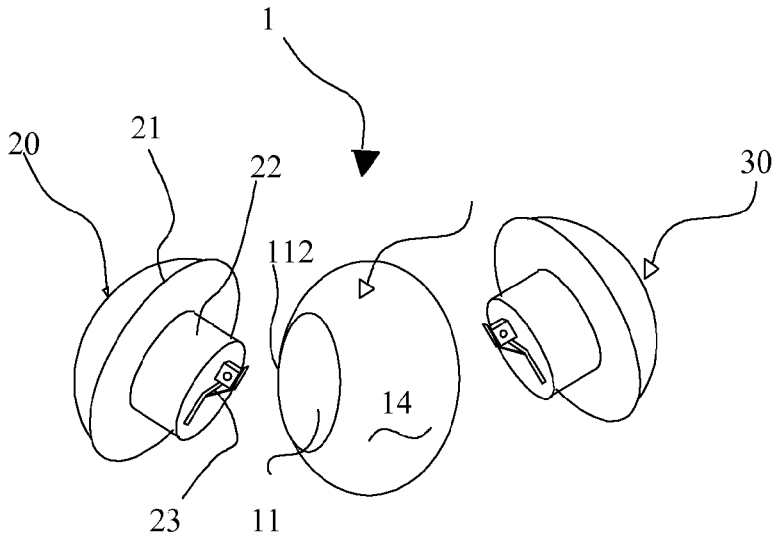

This application is the U.S. national phase of International Application No. PCT/EP2009/059593, filed 24 Jul. 2009, which designated the U.S. and claims priority to France application Ser. No. 08/55103 filed 25 Jul. 2008, the entire contents of each of which are hereby incorporated by reference.

The present invention lies in the field of jewellery. More particularly the invention relates to a jewellery assembly made up of at least three pieces, in particular a ring and a pair of earrings, which can be linked together so as to create for example a single stable geometric shape.

The presentation of jewellery, its enhancement and preparation for sale are very important in the field of jewellery.

When various pieces of jewellery such as earrings, a ring and a necklace form a matching set, they are generally arranged side by side on the same display unit or in the same case. More particularly, the pieces of the same set are often arranged side by side to create a visual link between them and thus draw the consumer's attention to the beauty of the assembly. Such a method of presentation able to attract attention of the consumer and evoke curiosity is not however easy to achieve as it is difficult to link several pieces of jewellery of different shape together without using visible or clumsy means such as pins or supports.

The aim of the present invention is to propose a jewellery assembly made up of at least three pieces, one ring and two earrings comprising a matching set, which can be linked together in a stable, provisionally fixed manner in a specific shape using discreet connecting means.

To this end a jewellery assembly according to the invention is of the type made up of at least three pieces comprising a matching set, a ring with a body through which passes a through hole intended for example for the passage of a finger, and two earrings each with ornamental portions, means of attachment to the earlobes and cylindrical intermediate portions between the attachment means and the ornamental portions and intended to be inserted into the hole in the ring, and is characterised in that the assembly comprises a linking means comprising at least one annulus intended to connect the earrings to said ring.

According to a first embodiment, the earrings have grooves around the circumferences of the lateral sides of the cylindrical intermediate portions, the grooves housing split elastic annuli respectively encircling the cylindrical intermediate portions and comprising two ends intended to be brought together when the split elastic annuli are compressed, and the ring comprises at least one groove intended to allow housing of said split elastic annuli and means of compression of the split elastic annuli, of which a first compression means is intended to allow the housing of the split elastic annuli in the groove or grooves of the ring when the cylindrical intermediate portions of the earrings are engaged in the hole in the ring so as to interconnect the earrings and the ring, and a second means of compression is provided to allow separation of the split elastic annuli from the ring groove or grooves when the cylindrical intermediate portions are released from the ring so as to separate the earrings from the ring.

When the pieces comprising the assembly are joined together, no connecting means is visible. Also the split elastic annuli have the advantage of allowing rotation of the earrings in relation to the ring. This gives the assembly a fun aspect as rotation of the pieces in relation to each other allows modification of the appearance of the assembly or can reveal inscriptions or written expressions.

According to a first variant of this embodiment the ring comprises two grooves arranged on the circumferences of the two edges of the wall of hole in the ring and intended to house the split elastic annuli in the grooves of the ring respectively when the cylindrical intermediate portions of the earrings are engaged in the hole of the ring so as to connect the earrings with the ring.

According to a second variant of this embodiment, the ring comprises a groove extending between the two ends of the hole wall and intended to allow housing of said split elastic annuli in the groove of the ring when the cylindrical intermediate portions of the earrings are engaged in the hole of the ring so as to connect the earrings with the ring.

According to one embodiment of the invention, the first compression means provided to allow housing of the split elastic annuli in the grooves of the ring is composed of chamfers on the edges of the hole wall of said ring before the grooves, the chamfers being provided to compress the split elastic annuli when the cylindrical intermediate portions of the earrings are engaged in the ring hole.

The chamfered parts are provided to cause the longitudinal expansion of the split elastic annuli when the cylindrical intermediate portions of the earrings are engaged in the ring hole. This expansion allows the ends of the annuli to be moved towards each other which allows the annuli to tighten around the cylindrical intermediate portions and to come to rest in the grooves of the ring without touching its edges.

Advantageously the second compression means provided to allow the separation of the split elastic annuli from the grooves of the ring is composed of flared edges of the grooves of the ring allowing compression of the split elastic annuli when the cylindrical intermediate portions of the earrings are separated from the ring hole.

The flared edges behave as the chamfered parts allowing expansion of the split elastic annuli and their tightening around the cylindrical intermediate portions of the earrings so as to be extracted from the grooves of the ring.

According to another embodiment of the invention, the second means of compression of the split elastic annulus provided to allow removal of the split elastic annuli from the grooves of the ring is composed of chamfers arranged in the edges of the ring groove or grooves adjacent to these edges.

According to another embodiment of the invention, the body of the ring comprises at least one opening communicating with said hole, the axis of revolution of which is perpendicular to the axis of revolution of the hole.

In this embodiment, the opening made in the body of the ring for example allows insertion of a pendant chain within the assembly.

In another embodiment of the invention, the distance separating the grooves arranged on the circumference of the cylindrical portions and the ornamental portions is such that a slot allowing passage for example of a fingernail is created between the ornamental portions and the body of the ring when the cylindrical intermediate portions of the earrings are engaged in the ring hole so as to connect the earrings to the ring.

Advantageously the edge of the ornamental portions comprises a notch intended to facilitate handling of the earring.

According to a second embodiment of the invention, the assembly furthermore comprises an annulus intended to encircle at least one part of the ring and the earrings and to hold the cylindrical intermediate portions of the earrings inserted in the ring hole, and a means of blocking said annulus, activatable by a user, which is intended to prevent the annulus from moving in the axis of the ring.

This external annulus can be mobile in rotation around the interconnected ring and earrings but whatever its position around this assembly and because of the blocking means, it always covers at least part of the three pieces and more particularly a portion of the joints between the pieces. The blocking means limits the rotation of the annulus and prevents this from moving around the ring so as to release the earrings. Consequently the earrings cannot be released from the ring. The blocking means can however be activated deliberately in order to authorise any movement of the annulus and separate the assembly.

Advantageously the ring comprises an opening which is in communication with said hole, the axis of revolution of which is perpendicular to the axis of revolution of said hole and a cutout communicating with this opening, said opening revealing the blocking means.

According to this embodiment, the blocking means comprises a part which is housed inside the ring hole, at least one portion of which protrudes through the opening made in the ring when the cylindrical intermediate portions of the earrings are engaged in the hole.

Advantageously the blocking means is carried by a chain contained in the jewellery assembly and comprises a base of diameter greater than that of the opening and a summit of diameter less than that of the opening.

The summit of the part protrudes through the opening in the ring. When the user wishes to separate the assembly formed by the ring and the earrings, he actuates this part by moving it in the direction of the cutout. The annulus can then be positioned in the axis of the ring and the earrings are released from the ring.

According to one embodiment of the invention, the earrings and the ring are segments of a single piece, the shape of which lies within a polyhedron when the cylindrical intermediate portions of the earrings are engaged in the ring hole so as to connect the earrings with the ring.

In such an embodiment, the pieces of the set then form a perfectly homogenous assembly as they are interconnected to form one single piece. The means used to connect the assembly are perfectly discreet and will not spoil the appearance of the assembly.

According to such an embodiment, the single piece is a sphere.

Figure 2:
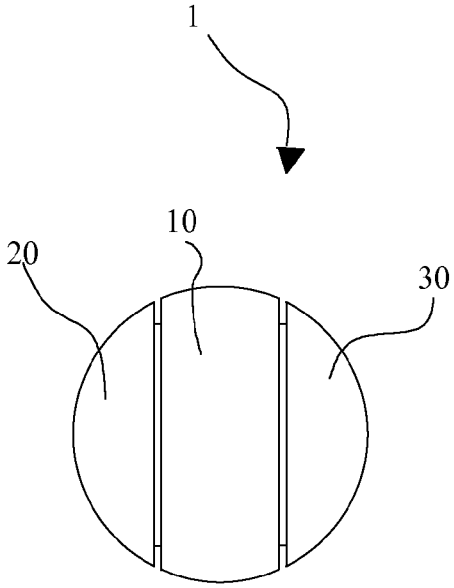
Figure 3:
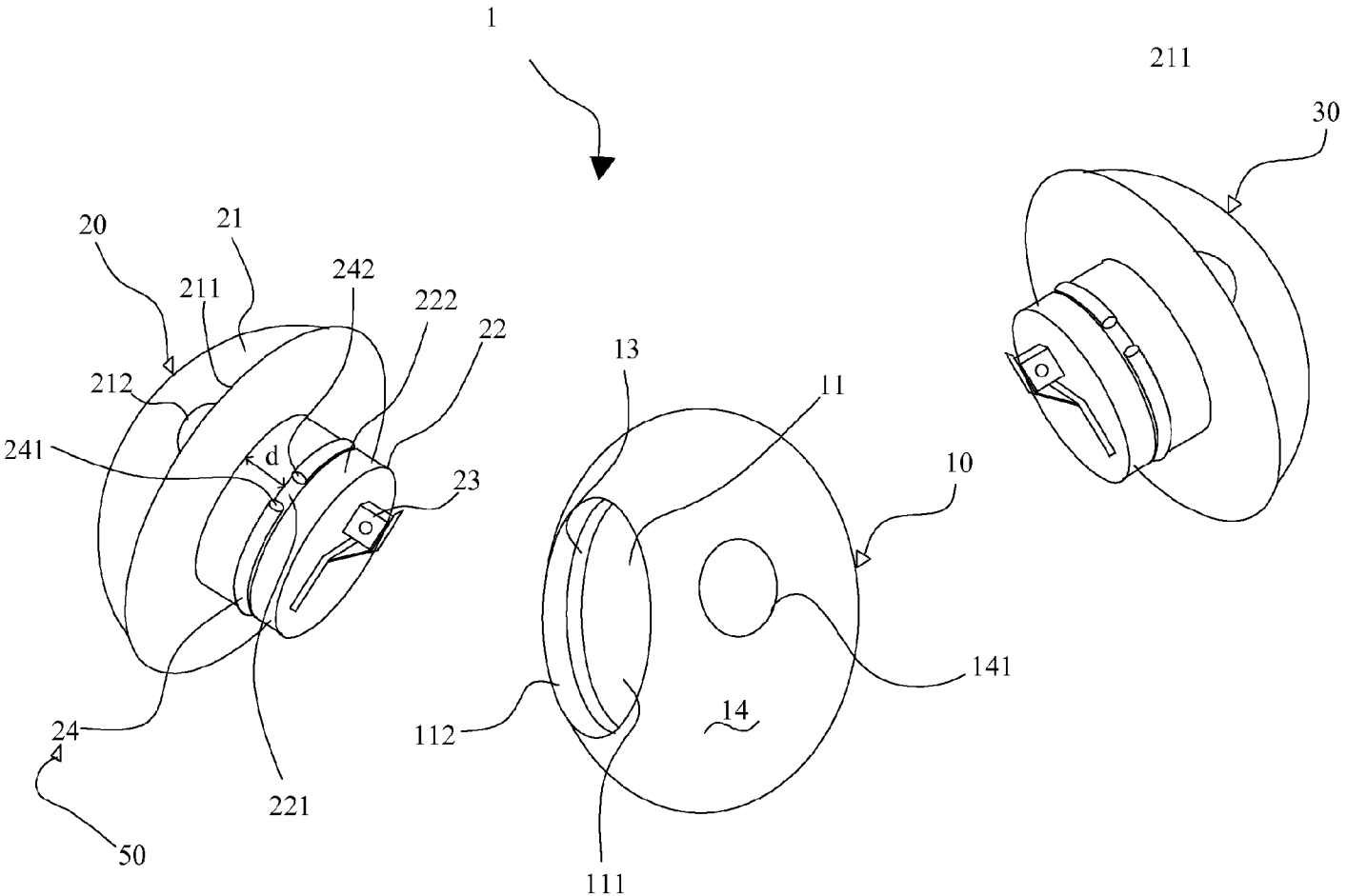
Figure 4A:
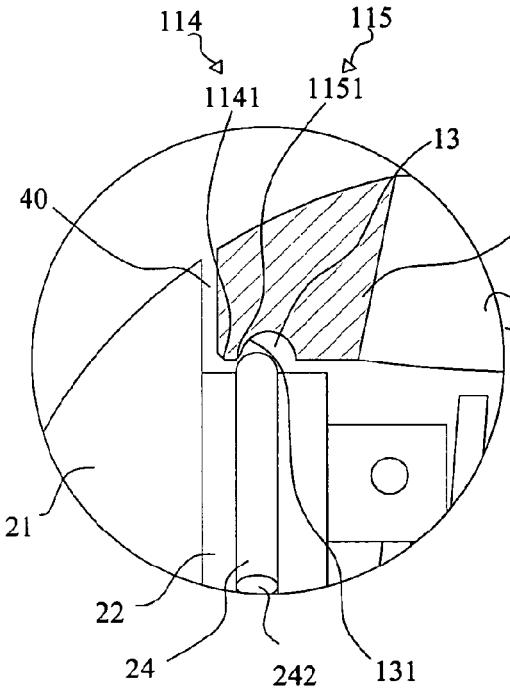
Figure 4B:
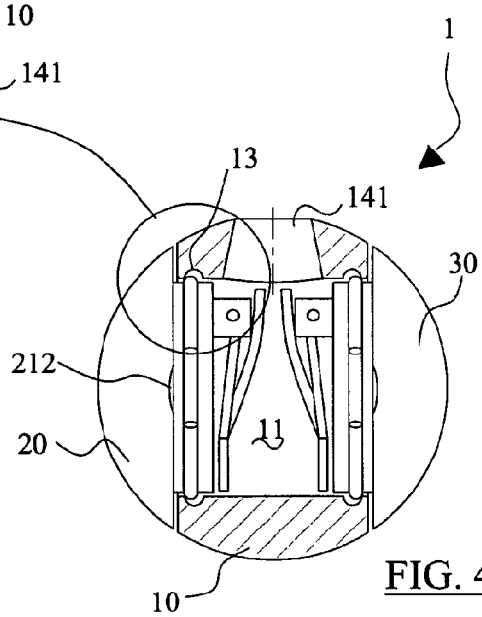
Figures 4C, 4D:
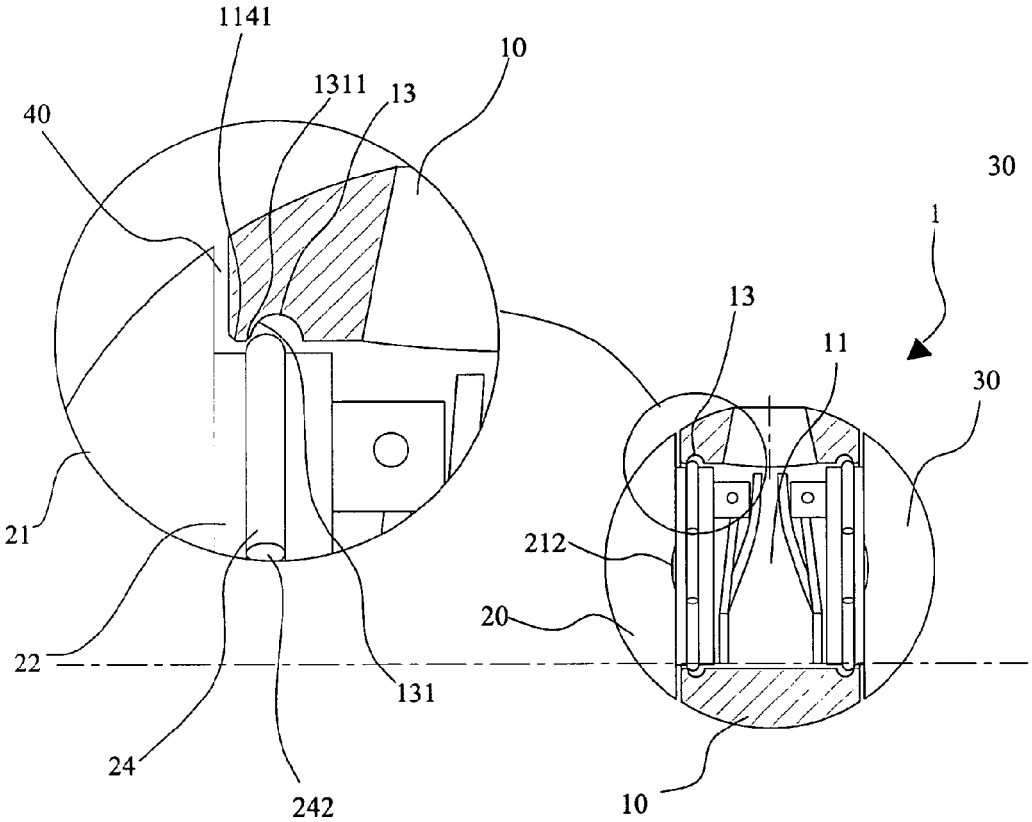
Figure 5A:
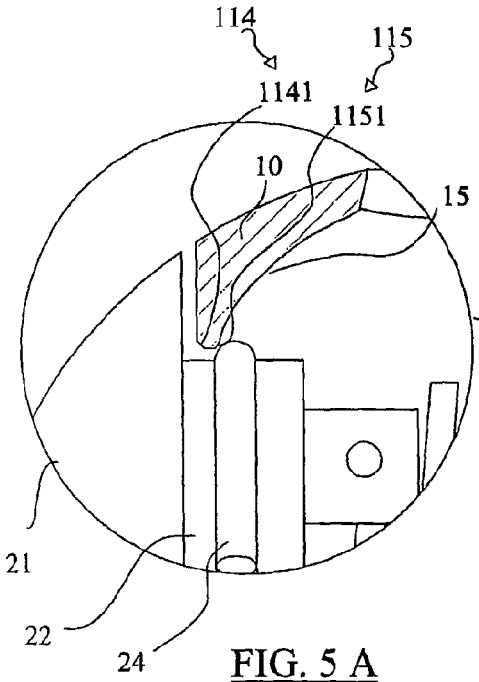
Figure 5B:
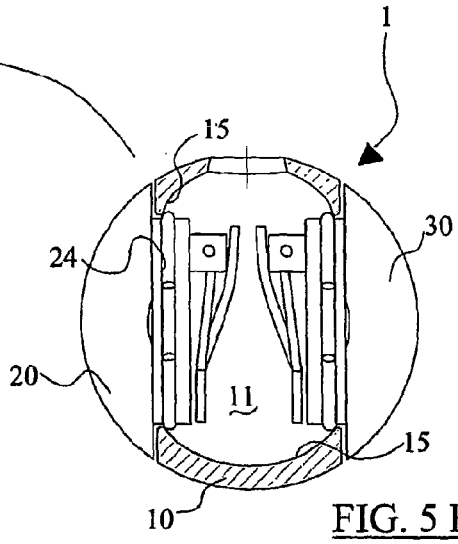
Figure 6:
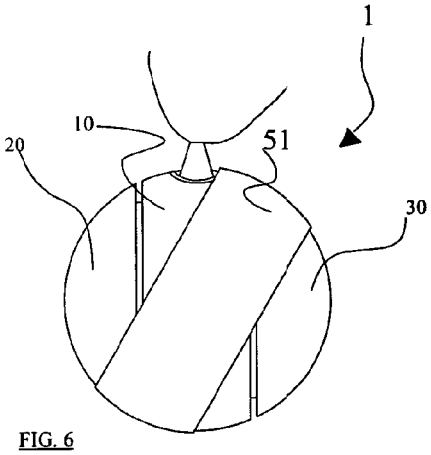
Figure 7:
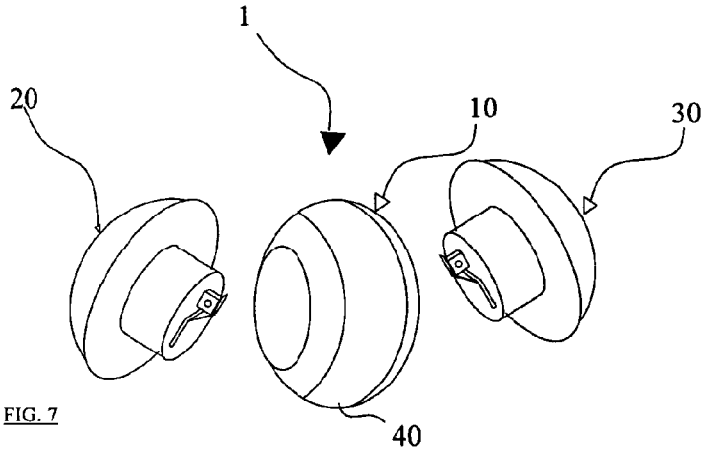
Figure 8:
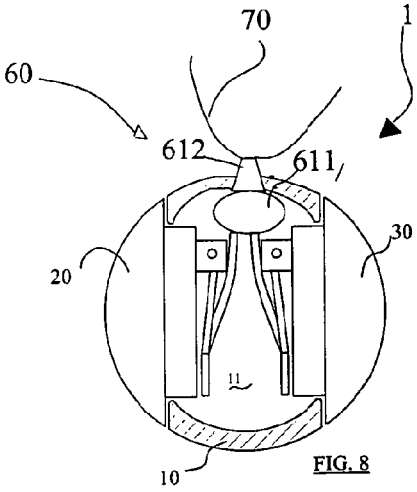
Figure 9:
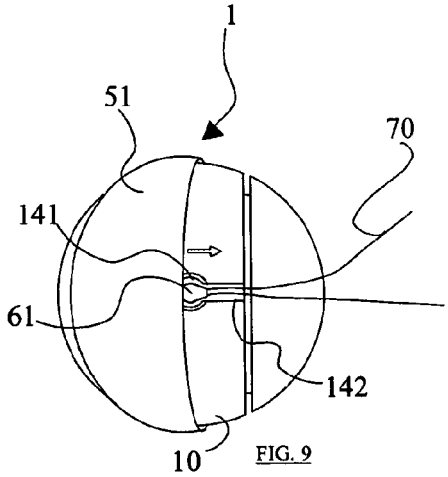

The characteristics of the invention mentioned above and others will appear more clearly from reading the description below of embodiment examples, said description being produced in relation to the attached drawings in which:

FIG. 1 shows a perspective view of an assembly according to the invention comprising a ring and two earrings not linked together, FIG. 2 shows a diagrammatic front view of an assembly according to the invention comprising a ring and two earrings linked together, FIG. 3 shows a perspective view of an assembly comprising a ring, two earrings and a linking means according to a first variant of a first embodiment of the invention, FIGS. 4A and 4B show a cross section view and a detail view of a ring and two earrings of an assembly according to the first variant of the first embodiment of the invention, said ring and earrings being interconnected, FIGS. 5A and 5B show a section view and a detail view of a ring and two earrings of an assembly according to a second variant of the first embodiment, said ring and earrings being interconnected, FIG. 6 shows a diagrammatic front view of an assembly according to a second embodiment of the invention comprising a ring and two earrings linked together, FIG. 7 shows a perspective view of an assembly comprising a second embodiment of the invention with a ring and two earrings not linked together, FIG. 8 shows a section view of a ring and two earrings of an assembly according to the second embodiment of the invention, said ring and earrings being connected together, FIG. 9 shows a diagrammatic front view of an assembly according to the second embodiment of the invention comprising a ring and two earrings linked together.

FIG. 1 shows an assembly 1 according to the invention made up of at least three pieces with one ring 10 and two earrings 20, 30. The two earrings being identical, only the earring 20 is described below.

The ring 10 comprises a body 14 through which passes a through hole 11 intended for example for the passage of a finger. The walls 111 of the hole 11 have a circular perimeter and two edges such as edge 112.

The earring 20 comprising an ornamental portion 21 corresponding to the ornamental portion of the earring visible when this is worn by a user. The earring 20 can be attached to an earlobe by fixing means 23 such as a clip device or any other known fixing means.

The earring 20 also comprises a cylindrical intermediate portion 22 between the fixing means 23 and the ornamental portion 21. The cylindrical intermediate portion 22 carries the fixing means 23.

The cylindrical intermediate portion 22 is intended to be inserted inside the hole 11 of the ring 10 so as to interconnect the assembly 1 as a single piece. Such a piece is shown in FIG. 2. According to the invention, the single piece can take any shape lying within a polyhedron.

The assembly 1 is connected together via a linking means described below.

FIG. 3 shows an assembly 1 according to a first variant of a first embodiment.

In this embodiment the cylindrical intermediate portion 22 of the earring 20 comprises a groove 221 arranged on the circumference of the lateral edge 222 of the cylindrical body 22. The groove 221 houses a split elastic annulus 24 which encircles the cylindrical intermediate portion. This annulus 24 has two ends 241, 242 which are intended to be brought together when the annulus is compressed. The earring 30 comprises the same characteristics as the earring 20. The elastic annuli such as annulus 24 form a linking means 50 intended to connect the ring 10 with the earrings 20, 30.

The ring 10 comprises grooves such as groove 13 arranged on the circumference of these edges such as edge 112.

So as to connect the earring with the ring, the split elastic annulus 24 must be housed in the groove 13 of the ring. To do this, the ring 10 comprises a first means 114 of compression of the elastic annulus 24 comprising a chamfer 1141 arranged on the circumference of edge 112 before the groove 13 (FIG. 4A). Thus when the cylindrical intermediate portion 22 of the earring 20 is inserted in the hole 11 of the ring 10, the split elastic annulus 24 comes to rest against the chamfer 1141 and is compressed. The effect of the compression is to extend the elastic annulus i.e. bring its ends 241 and 242 towards each other, and thus reduce the diameter of the annulus. The cylindrical intermediate portion 22 can then progress in the hole 11 until the split elastic annulus 24 is housed in the groove 13. Once housed in the groove 13, the split elastic annulus resumes its initial form and the two ends 241, 242 move apart from each other.

The earring 30 is connected with the ring 10 in the same way.

When the earrings and the ring are interconnected in this way, no fixing means is visible and will not spoil the appearance of the resulting single piece.

The split elastic annulus 24 allows the earring 20 to rotate in relation to the ring 10 such that it is possible to thus modify either the shape of the assembly 1 when the earrings and ring are joined together, for example by modifying the shape of the resulting single piece, or to reveal and conceal messages inscribed on the parts of the assembly.

The distance d separating the groove 221 arranged on the periphery of the cylindrical portion 22 from the ornamental portion 21 of the earring 20 is such that a slot 40 is created between the ornamental portion 21 and the body 14 of the ring 10 when the cylindrical intermediate portion 22 is engaged in the hole 11 of the ring 10, i.e. when the earring 20 is connected with the ring 10 to form a single piece (FIG. 2, FIG. 3). The slot 40 is sufficient space to allow for example the passage of a fingernail used to separate the cylindrical intermediate portion 22 from the hole 11 of the ring 10 i.e. to separate the earring 20 from the ring 10.

The ornamental portion 21 also comprises in its edge 211 a notch 212 intended to facilitate further the handling of the earring 20.

To allow separation of the parts of the assembly, the ring 10 also comprises a second means of compression 115 which is provided to allow separation of the split elastic annulus 24 from the groove 13 of the ring 10 (FIG. 4A). This second means of compression 115 is composed of a chamfer 1311 arranged in the edge 131 of the groove 13 of the ring 10 which is adjacent to edge 112. The chamfer 1151 allows compression of the split elastic annulus 24 when the cylindrical intermediate portion 22 is separated from the ring 10.

In another embodiment not shown, the second means of compression provided to allow separation of the split elastic annulus 24 from the groove 13 is composed of a flared edge of the groove. A flared edge then behaves in the same way as a chamfer allowing compression of the split elastic annulus 24.

The body 14 of the ring 10 can furthermore comprise at least one opening 141 communicating with the hole 11, the axis of revolution of which is perpendicular to the axis of revolution of the hole 11. This opening 141 allows the hole of another piece of the assembly 1 such as a pendant chain. This other piece can then be arranged inside the single piece created by the connection of the earrings 20, 30 with the ring 10.

FIGS. 5A and 5B show a second variant of the invention. In this variant the earrings 20 and 30 have identical characteristics to those described in the previous embodiment. The ring 10 itself comprises a single groove 15. This extends from one edge 112 to the other of the wall of the hole 11.

Compression means 114 and 115 identical to those described above are also provided in this variant in order to allow respectively the housing of the split elastic annulus 24 in the groove 15 when the cylindrical intermediate portion 22 of the earring 20 is engaged in the hole 11 of the ring 10, and the release of the annulus 24 from the groove 15 when the cylindrical intermediate portion 22 of the earring 20 is separated from the hole 11.

FIG. 6 shows another embodiment of the invention.

In this embodiment the assembly 1 conforms to the assembly shown in FIG. 1. It therefore comprises a ring 10 with a body 14 through which, from one side to the other, passes a hole 11. The earring 20 comprises an ornamental portion 21, fixing means 23 and a cylindrical intermediate portion 22 between the fixing means 23 and the ornamental portion 21. The cylindrical intermediate portion 22 carries the fixing means 23. The cylindrical intermediate portion 22 is intended to be inserted inside the hole 11 of the ring 10 so as to connect the assembly 1 into a single piece.

The ring 10 has an opening 141 communicating with the hole 11, the axis of revolution of which is perpendicular to the axis of revolution of the latter.

The assembly 1 furthermore comprises an external annulus 51 which encircles at least one part of the ring 10 and at least one part of the earrings 20 and 30 as shown on FIG. 6. In this condition a part of the joints between the three visible pieces of the assembly 1 is covered by the annulus 51. The external annulus 51 therefore holds the cylindrical intermediate portions of the earrings 20 and 30 inside the hole 11 of the ring 10.

The external annulus 51 is a part harmonising with the other pieces of the assembly 1. It can be made of the same material as the other pieces and carry aesthetic elements such as pearls or engraving.

A means 60 for blocking the external annulus 51 is also provided. The purpose of this blocking means is to prevent the annulus 51 from moving in the axis of the ring 10. In fact when the annulus is positioned in the axis of the ring 10, it covers this alone. In this position the earrings are released and the cylindrical intermediate portions 22 leave the hole 11 (FIG. 7).

In this embodiment, the blocking means comprises a part 61 which is housed inside the hole 11 of the ring 10 (FIG. 8). This part 61 can advantageously be carried by a chain 70. The part 61 has a base 611 of diameter greater than that of the opening 141 and a summit 612 of diameter less than that of the opening 141. Consequently the part 61 comprises at least one portion protruding through the opening 141 made in the ring 10 when the cylindrical intermediate portions 22 are engaged in the hole 11.

The blocking means 60 can be actuated by the user so as to separate the assembly 1.

To do this a cutout 142 is arranged in the ring 10 and communicates with the opening 141 (FIG. 9).

The blocking means 60 is free and can be moved or inclined in the direction of the cutout 142 in which it is housed. When this means is composed of a part 61 carried by a chain 70, the chain can also be housed in the cutout 142 as shown on FIG. 9.

Once the part 61 or more particularly the portion of the part 61 protruding from the opening 141 and the chain 70 are housed in the cutout 142, the external annulus 51 can be moved until it lies in the axis of the ring 10 as indicated by the arrow on FIG. 9. The assembly is then separated.

The invention claimed is:

1. Jewellery assembly (1) of the type made up of at least three pieces constituting a matching set, with a ring (10) comprising a body (14) through which passes a through hole (11) and two earrings (20, 30) comprising respectively ornamental portions (21), means (23) for attaching to the earlobes and between said attaching means (23) and said ornamental portions (21), cylindrical intermediate portions (22) intended to be inserted in the hole (11) of said ring (10), characterised in that the assembly (1) comprises a linking means (50) comprising at least one annulus (24, 51) intended to connect the earrings (20, 30) with said ring (10); characterised in that said earrings (20, 30) comprise grooves (221) on circumferences of lateral sides (222) of said cylindrical intermediate portions (22), said grooves (221) housing split elastic annuli (24) respectively encircling said cylindrical intermediate portions (22) and comprising two ends (241, 242) intended to be brought together when said split elastic annuli (24) are compressed, and in that said ring (10) comprises at least one groove (13, 15) intended to allow housing of said split elastic annuli 24 and a means of compression of said split elastic annuli (24), of which a first compression means (114) is intended to allow housing of said split elastic annuli (24) in said groove or grooves of said ring (10) when said cylindrical intermediate portions (22) of said earrings (20, 30) are engaged in the hole (11) of said ring (10) so as to connect said earrings (20, 30) with said ring (10), and of which a second compression means (115) is provided to allow the removal of said split elastic annuli (24) from said groove or grooves (13) of said ring (10) when said cylindrical intermediate portions (22) are released from said ring (10) so as to separate said earrings (20) from said ring (10).

2. Jewellery assembly (1) according to claim 1, characterised in that said ring (10) comprises two grooves (13) arranged on circumferences of two edges (112) of the wall of hole (111) and intended to allow housing of said split elastic annuli (24) in said grooves (13) of said ring (10) respectively when said cylindrical intermediate portions (22) of said earrings (20, 30) are engaged in the hole (11) of said ring (10) so as to connect said earrings (20, 30) with said ring (10).

3. Jewellery assembly (1) according to claim 1, characterised in that said ring (10) comprises a groove (15) extending between two edges (112) of the wall of hole (111) and provided to allow housing of said elastic split annuli (24) in said groove (13) of said ring (10) when said cylindrical intermediate portions (22) of said earrings (20, 30) are engaged in the hole (11) of said ring (10) so as to connect said earrings (20, 30) with said ring (10).

4. Jewellery assembly (1) according to any of claims 1, 2 or 3 characterised in that said first compression means (114) intended to allow housing of said split elastic annuli (24) in said groove or grooves (13) of said ring (10) is composed of chamfers (1411) of the edges (112) of the wall (111) of the hole (11) of said ring (10) before said groove or grooves (13), said chamfers (1411) being intended to compress the split elastic annuli (24) when said cylindrical intermediate portions (22) of said earring (20) are engaged in said hole (11) of said ring (10).

5. Jewellery assembly (1) according to claim 1, characterised in that said second compression means (115) intended to allow the separation of said split elastic annuli (24) from said groove or grooves (13) of said ring (10) is composed of flared edges of the groove or grooves (13) of said ring (10) allowing compression of the split elastic annuli (24) when said cylindrical intermediate portions (22) of said earrings (20) are released from said hole (11) of said ring (10).

6. Jewellery assembly (1) according to claim 1, characterised in that said second means (115) of compression of the split elastic annulus (24) is composed of chamfers (1511) arranged in the edges (131) of the grooves (13) of said ring (10) which are adjacent to said edges (112) of said ring (10) so as to allow compression of the split elastic annuli (24) when said cylindrical intermediate portions (22) of said earrings (20) are separated from said hole (11) of said ring (10).

7. Jewellery assembly (1) according to claim 1, characterised in that the body (14) of said ring (10) comprises at least one opening (141) communicating with said hole (11), the axis of revolution of which is perpendicular to the axis of revolution of said hole (11).

8. Jewellery assembly (1) according to claim 1, characterised in that the distance (d) between said grooves (221) arranged on the circumference of said cylindrical intermediate portions (22) of said earrings (20) and said ornamental portions (21) is such that a slot (40) allowing passage of a fingernail for example is created between said ornamental portions (21) and the body (14) of said ring (10) when said cylindrical intermediate portions (22) are engaged in said hole (11) of said ring (10) so as to connect said earrings (20) with said ring (10).

9. Jewellery assembly (1) according to claim 1, characterised in that the edge (211) of said ornamental portion (21) comprises a notch (212) intended to facilitate the handling of said earring.

10. Jewellery assembly (1) of the type made up of at least three pieces constituting a matching set, with a ring (10) comprising a body (14) through which passes a through hole (11) and two earrings (20, 30) comprising respectively ornamental portions (21), means (23) for attaching to the earlobes and between said attaching means (23) and said ornamental portions (21), cylindrical intermediate portions (22) intended to be inserted in the hole (11) of said ring (10), characterised in that the assembly (1) comprises a linking means (50) comprising at least one annulus (24, 51) intended to connect the earrings (20, 30) with said ring (10); characterised in that said assembly furthermore comprises an external annulus (51) intended to encircle at least one part of said ring (10) and said earrings (20, 30) and to hold said cylindrical intermediate portions (22) inserted in the hole (11) of said ring (10), and a means (60) for blocking said external annulus which can be actuated by a user and which is intended to prevent said external annulus (51) from moving in the axis of said ring (10).

11. Jewellery assembly (1) of the type made up of at least three pieces constituting a matching set, with a ring (10) comprising a body (14) through which passes a through hole (11) and two earrings (20, 30) comprising respectively ornamental portions (21), means (23) for attaching to the earlobes and between said attaching means (23) and said ornamental portions (21), cylindrical intermediate portions (22) intended to be inserted in the hole (11) of said ring (10), characterised in that the assembly (1) comprises a linking means (50) comprising at least one annulus (24, 51) intended to connect the earrings (20, 30) with said ring (10); characterised in that said ring (10) comprises an opening (141) which is communication with said hole (11), the axis of revolution of which is perpendicular to the axis of revolution of said hole (11), and a cutout (142) in communication with said opening, said opening revealing the blocking means (60).

12. Jewellery assembly (1) according to any of claims 9, 10 or 11, characterised in that said blocking means (60) is composed of a part (61) housed inside the hole (11) of the ring (10), and of which at least one portion protrudes through the opening (141) made in the ring (10) when the cylindrical intermediate portions (22) of the earrings (20, 30) are engaged in the hole (11).

13. Jewellery assembly (1) according to any of claims 9, 10 or 11, characterised in that said blocking means (60) is carried by a chain (70) held in the jewellery assembly (1) and comprising a base (611) of diameter greater than that of the opening (141) and a summit (612) of lesser diameter.

14. Jewellery assembly (1) according to claims 1, 10 or 11, characterised in that said earrings (20) and said ring (10) are segments of a single piece, the shape of which lies within a polyhedron when said cylindrical intermediate portions (22) of said earrings (20) are engaged in said hole (11) of said ring (10) so as to connect said earrings (20) with said ring (10).

* * * * *